United States Patent [19]

Matsui et al.

[11] Patent Number: 4,461,791

[45] Date of Patent: Jul. 24, 1984

[54] FUR-LIKE ARTICLE HAVING PILE WITH DIFFERENCE IN COLOR OR FINENESS

[75] Inventors: Masao Matsui, Takatsuki; Kazuo Okamoto; Takao Osagawa, both of Osaka, all of Japan

[73] Assignees: Kanebo, Ltd., Tokyo; Kanebo Synthetic Fibers Ltd., Osaka, both of Japan

[21] Appl. No.: 403,591

[22] PCT Filed: Jan. 14, 1982

[86] PCT No.: PCT/JP82/00014

§ 371 Date: Jul. 28, 1982

§ 102(e) Date: Jul. 28, 1982

[87] PCT Pub. No.: WO82/02410

PCT Pub. Date: Jul. 22, 1982

[30] Foreign Application Priority Data

Jan. 15, 1981 [JP] Japan ..... 56-4725
Jan. 21, 1981 [JP] Japan ..... 56-8318

[51] Int. Cl.[3] ..... A01N 1/00

[52] U.S. Cl. ..... 428/15; 428/16; 428/17; 428/88; 428/89; 428/91; 428/92

[58] Field of Search ..... 428/88, 89, 91, 17, 428/15, 16, 92

[56] References Cited

U.S. PATENT DOCUMENTS

| | | | |
|---|---|---|---|
| 2,400,487 | 5/1946 | Clark | 428/89 |
| 3,509,004 | 4/1970 | Becker | 428/89 |
| 4,340,631 | 7/1982 | Endo | 428/89 |

*Primary Examiner*—Marion McCamish
*Attorney, Agent, or Firm*—Flynn, Thiel, Boutell & Tanis

[57] ABSTRACT

A fur-like article having three dimensionally varied piles characterized in that at least one part of piles varies at least one of color, length and fineness along a surface, the distance of which varies with respect to a substrate fabric of said fibrous article is produced by rotating a fibrous structure having piles fixed on a supporting body to raise the piles owing to centrifugal force caused by the rotation and contacting the raised piles with a treating liquid for fibers which is retained in a rotary container and forms a cylindrical interface due to the centrifugal force, so that the distance of the interface of the treating liquid from a substrate fabric of said pile article varies according to place, to vary at least one of the color, length and fineness of the piles.

15 Claims, 26 Drawing Figures

FUR-LIKE ARTICLE HAVING PILE WITH DIFFERENCE IN COLOR OR FINENESS

TECHNICAL FIELD

The present invention relates to pile articles and particularly pile articles having a high grade of appearance and feeling in which the appearance of piles, that is at least one of color, length and fineness, varies according to place and a method for producing the pile articles.

BACKGROUND ART

Fibrous products having piles, such as cut piles or loop piles, have unique various appearances and feelings and are broadly used.

An object of production of these pile articles is to obtain fur-like articles. However, as well-known, natural furs have very complicated, delicate and high grade of colors and structures and the artificial production thereof has been substantially impossible. For example, a major part of natural furs consist of "guard hairs (tough hairs)" and "wools (soft hairs)" and have very precise piles wherein the guard hairs differ in the color and the filament diameter at the root portion, middle portion and top portion. Heretofore, many methods for producing fur-like articles in which the diameter of the filament is varied at the root portion, middle portion and top portion, have been proposed but in these methods, the fineness and length of the piles are either mechanically uniform and simple, or randomly uneven and irregular and these articles are far inferior to natural furs having complicated and precise structure. Almost all fur-like articles produced in the conventional methods do not have the complicated, precise and high grade of structures as in natural furs in the piles and are a low grade of imitation.

DISCLOSURE OF INVENTION

The first object of the present invention is to provide novel pile articles having complicated, precise and high grade of colors and structures and/or feels which are comparable with natural furs and a method for producing said articles.

The second object of the present invention is to provide novel pile articles having a high grade of fashionability, design, aesthetic property and feel and a method for producing said articles.

The pile articles of the present invention have an appearance wherein at least a part of the piles varies three-dimensionally in at least one of the color, length and fineness along a surface which varies the distance with respect to the substrate fabric.

The method of the present invention is characterized in that a fibrous structure having piles fixed to a support is rotated, the piles raised owing to the centrifugal force are contacted with a fiber treating liquid which is charged in a rotating cylinder and forms a cylindrical interface due to the centrifugal force by varying a distance between the treating liquid interface and a substrate fabric according to place to vary at least one of color, length and diameter of the piles.

The term "piles" to be used in the present invention means cut piles, loop piles, raised fibers and any other piles. The fibrous structures mean knitted fabrics, woven fabrics, non-woven fabrics and the like.

FIGS. 1–15 are explanatory sectional views showing the pile articles of the present invention.

High grade pile articles and a major part of animal furs consist of long guard hairs 3 having a large diameter and fine short wools 2. In the major part of furs, the guard hairs are fine and sharp at the top end portion, have a large diameter at the middle portion and have a small diameter at the root portion, and also in high grade pile articles, such requirements are desired. 1 is a skin portion in a natural fur, but in the artificial products, such a portion is referred to as a substrate fabric consisting of a woven fabric, fibers, a non-woven fabric and the like. The substrate fabric 1, in many cases, may contain a polyurethane elastomer, rubbery or non-elastic resins or may not contain such a substance.

As a method for producing pile articles, a method for flocking piles when knitting or weaving by means of a pile weaving or knitting machine etc., a method using a sliver knitting machine and the like, raising methods, tufting methods, electric flocking methods and other pile producing methods may be applied.

The pile articles of the present invention are characterized in that a part or the whole of the piles has three-dimensionally varied colors, finenesses and/or lengths, and the variation of the appearance is caused along a certain surface (plane or curved surface).

FIGS. 1–9 are embodiments wherein the color of the piles varies along a surface where the distance from the substrate fabric varies.

In FIG. 1, the guard hairs 3 have different colors at the upper portion and the lower portion of the surface AA′ and the surface AA′ inclines with respect to the substrate fabric, so that the color of the guard hairs differs according to place. For example, if the guard hairs are white at the upper portion of the surface AA′ and black at the lower portion, the guard hairs positioned at the right side of this view have much black portion and the guard hairs at the left side have much white portion. At the more extended positions toward the right side or the left side, the guard hairs colored only white and the guard hairs colored only black are admixed.

FIG. 2 shows an embodiment wherein the guard hairs are different at the upper portion along the surface AA′, the portion between the surface AA′ and the surface BB′ and the lower portion along the surface BB′ respectively (the upper portion along the surface AA′ and the lower portion along the surface BB′ may be the same color).

FIG. 3 shows an embodiment wherein a part (3*a*) of the guard hairs have different colors at five portions divided by the surfaces AA′, BB′, CC′ and XX′, each portion being different from the adjacent portion.

FIG. 4 shows an embodiment wherein the guard hairs are light color (for example white) at the upper portion above the surface AA′, a deep color (for example black) at the lower portion below the surface BB′ and graduated color which gradually varies from a light color (for example light grey) to a deep color (for example black) through an intermediate deep color (for example grey), between the surface AA′ and the surface BB′. In the present invention, both the case where the color is distinctly (suddenly) varied at the upper and lower sides of the surface AA′ as shown in FIG. 1 and the case where the color is gradually varied between a certain surface and another surface as shown in FIG. 4 are referred to as "a color varies along the surface". Such a surface is referred to as the "color varying surface" hereinafter.

It is effective to vary the distance of the color varying surface with respect to the substrate fabric according to the place. That is, when the substrate fabric and the color varying surface are parallel, the uniform appearance is obtained without varying the color according to place but the high grade of appearance having a highly varied design can not be obtained.

For varying the distance of the color varying surface with respect to the substrate fabric, it is necessary to make said surface to be a three-dimensional surface, that is an inclined surface or a curved surface.

FIGS. 1–4 are embodiments wherein the color varying surface is inclined. FIGS. 5 and 6 are embodiments wherein the color varying surface is a curved surfaces. As the curved surface, use may be made of a cylindrical surface or a spherical surface but the curved surface, as shown in FIGS. 5–9, that is curved surfaces having a plurality of unevennesses are most rich in the variation and are useful in view of the design. As waved surfaces, use may be made of a sine wave, triangle wave, trapezoid wave, similar waves thereto, irregular waves and any other waves. For example, FIGS. 5 and 6 are similar waved surfaces to the sine wave, FIG. 7 is an embodiment of a trapezoid wave, FIG. 8 is an embodiment of a double trapezoid wave and FIG. 9 is an embodiment of a wave form wherein a triangle wave and a trapezoid wave are combined. However, a wave form which suddenly varies as in a rectangular wave, is unnatural in appearance, is poor in the high grade feeling and is not suitable for the object of the present invention. In order to give the fur-like natural appearance and the soft color, continuously varying wave forms are preferable. The wave form may be a regular geometrical one but may be irregular or complicated (similar to natural furs). The wave length is preferred to be about 1–10 cm but a larger wave length than said value can be used depending upon the design requirement. The inclined plane as shown in FIG. 1 is referred to as a part of a waved surface having a very large wave length. As a wave surface, a wave surface which is a waved form in one direction but is not a waved form in a direction perpendicular thereto (for example a slate corrugate used for a roofing material) or a two directionally waved surface which is a waved form in two directions intersected at right angles (for example ripples) is most complicated and high in the design value. The wave height (amplitude) is usually from about 0.5 cm to the maximum length of the pile and can be selected depending upon the required design.

As mentioned above, there are two cases of color variation in the longitudinal direction of the piles in the color varying surface, one of which is effected suddenly and distinctly and another of which is effected by graduation. When the variation is gradually (in gradient) effected along more than 4 mm, the graduated effect is recognized and this is referred to as "gradational effect". When the variation is effected within a distance of less than 4 mm, this is recognized to be the distinct sudden color variation and both the cases are useful in view of the design. The color variation means that the color is changed into a different color but the term "different color" means that the hue, chroma or lightness value is different to such an extent that they are distinguishable by the naked eye, for example, there is difference of more than 2.5 in the hue (H), more than 2 in the chroma (C) or more than 1 in the lightness (V) in Munsell indication.

FIGS. 10–15 are embodiments wherein the fineness and/or the length of the piles vary along surfaces where the distance from the substrate fabric varies according to place, that is three-dimensional surfaces. FIG. 10 is an embodiment wherein the length of the guard hairs 3 varies along an inclined plane AA', the fineness of the guard hairs 3 varies in the top portion along an inclined plane BB' and in the root portion along a surface XX' (horizontal surface). For example, when such a pile article is cut in a certain given width and the cut pile articles are seamed, a high grade of product having a very high design value, in which the piles and appearance vary, is obtained. FIG. 11 is an embodiment wherein the tops of the guard hairs 3 substantially coincide with the surface XX' (horizontal surface) and are parallel to the substrate fabric 1 (the length of the guard hairs is constant) but the fineness of the top portion of the guard hairs 3 varies along an inclined surface AA' and also at the root portion the fineness varies along a surface BB'. This pile article shows a delicately varying appearance and has a delicate touch in which the rigidity and the flexibility vary according to place and is a very valuable product. FIG. 12 is an embodiment wherein the length of the guard hairs 3 varies along a curved surface AA' and the fineness varies at the top portion along a surface BB' and at the root portion along a surface CC'. This pile article shows a wave swell-like appearance and has a highly varied feeling very similar to a natural fur. FIG. 13 is an embodiment wherein the length of the guard hairs 3 varies along a curved surface AA' but the fineness of the guard hairs 3 varies along a plane (horizontal surface) XX' at the top portion and along a plane (horizontal surface) at the root portion respectively. Accordingly, this pile article has a high grade of appearance and feeling in which the sharpened state at the top portion (the top angle or the gradient varying the fineness) varies delicately according to place. FIG. 14 is an embodiment wherein the length of the guard hairs 3 is even along a surface XX' (horizontal surface) but the fineness at the top portion varies along a curved surface AA' and the fineness at the root portion varies along a curved surface BB'. In this pile article, the sharpened state at the top portion and the rigidity and flexibility of the piles vary delicately according to place and this article is very valuable in view of appearance and touch. FIG. 15 is an embodiment in which the guard hairs consist of two filaments having a relatively small diameter (**3*a*) and a relatively large diameter (3*b***). The pile articles of the present invention may be partially admixed with piles having no variation in the fineness and length according to place.

When plural kinds of piles are mixed, if two kinds of fibers having different dyeabilities and coloring abilities are used, highly valuable pile articles having very complicated hues, appearances and touches can be obtained.

The case where the diameter of the filaments relatively distinctly (suddenly) varies at the upper side and the lower side of a surface BB' as shown in FIG. 10 and the case where the diameter of the filaments is gradually varied at the upper side and the lower side of a surface BB' as shown in FIG. 12, are referred to as different examples of the fineness of the filaments varying along a surface. Such a surface is referred to as a "fineness varying surface" hereinafter. In the present invention, the case where the length of the filaments varies along a surface AA' inclined with respect to the substrate fabric 1 as shown in FIG. 10 and the case where the length of the filaments varies along a curved surface AA' as in a wave swell as shown in FIG. 12 are referred to as examples of the length of the filaments varying along the surface AA'. Such a surface is referred to as "filament length varying surface".

It is effective that the length and/or the fineness of a part of or all piles of the products of the present invention vary along a surface wherein the distance from the substrate fabric is different according to place. The article wherein the variation of the length and the fineness of the piles is even in any portion is uniform, but said article is simple, and the article wherein these factors vary randomly gives a confused and irregular impression, and both the cases are not preferable. The articles according to the present invention can provide high grade of appearance and touch by selection the fineness varying surface and the filament length varying surface depending upon the aesthetic or design object.

It is effective that the fineness varying surface and the filament length varying surface are made to be a plane inclined with respect to the substrate fabric or a curved surface, that is a three-dimensional surface as in the color varying surface, and among them, a waved surface, that is a curved surface having a plurality of unevennesses (concave and convex) is most useful in design.

As the waved surface, any waves, such as a sine wave, a triangular wave, a trapezoidal wave, similar waves thereto, or irregular waves are used depending upon the design requirement. For example, FIGS. 12–15 show the wave surfaces similar to the sine wave. But, as the wave form, a suddenly varied wave form such as a square wave is unnatural in the appearance, is poor in the high grade of feeling and is not suitable for the object of the present invention. For giving a natural appearance, soft touch, and color similar to a fur, the wave form is preferred to be a continuously varied one. The wave form may be a regular geometrical one or an irregular complicated one (natural fur like). The wave length is often about 1–10 cm but a larger wave length may be used according to the requirement of design. A one directional wave surface is useful but a two directional wave surface is high in the design utility. The wave height (amplitude) can be selected according to the necessity in design from about 0.5 cm to the maximum length of the piles.

As mentioned above, there are the cases where the variation of the filament diameter in the longitudinal direction of the piles in the fineness varying surface is suddenly and distinctly effected and where said variation is gradually effected. The embodiment wherein this variation is gradually effected along a gradient of more than 4 mm gives a soft touch and appearance, and when the variation is effected within the distance of less than 4 mm, said variation is sudden and distinct or the filaments are cut. If necessary, such a variation is selected and more complicated and higher grades of articles can be obtained by combining plural kinds of variations.

The variation of the fineness of the top portion of the piles may be continuous (gradient) or step-wise. The top most end may be very fine or have a certain degree of fineness (about 10–100$\mu$) and if the top end is viewed by the naked eye so that the top end is sharpened as compared with the middle portion, such an article is effective. For example, it is desirable that the diameter of the top portion is less than 75%, particularly less than 50%, more particularly less than 25% of the diameter of the middle portion. Of course, ones wherein the tops of the piles are merely cut are included in the present invention when the length and/or color are varied along a three-dimensional surface.

Similarly, the root portion of the piles may be attenuated or not. The object for attenuating the root portion is to give flexibility to the piles and the diameter of the root or middle portion may be rendered to about 10–90% of the original diameter of the middle portion according to the desired flexibility.

The pile articles of the present invention include ones wherein all the color, length and fineness of the piles vary along the surface where the distance from the substrate fabric varies according to place and ones wherein the piles having no variation in the color, length and fineness are mixed in a part of the piles. For example, the pile articles wherein all the guard hairs vary the color, length and/or fineness along the color varying surface, the filament length varying surface and the fineness varying surface but the wools are uniform and do not vary the color, the filament length and the fineness, are also very useful. Similarly, wools having a uniform filament diameter and an uneven filament length or wools having varied fineness (in this case, the length of the filaments may be constant or different) are very useful. Pile articles wherein a part (at least 10%, preferably more than 30%, more particularly more than 50%) of the piles vary in color along the color varying surface and the other piles have a different color are useful. For example, in FIG. 3, the guard hairs (3*a*) vary in color along the color varying surfaces AA', BB' and CC' but the guard hairs (3*b*) do not vary the color according to place. By combining two or more kinds of piles having different colored states and varying the two-dimensional and three-dimensional color distribution of at least one kind of piles, articles having three-dimensionally varied appearance and color, for example articles having as highly varied appearance and high grade of design as a large number of natural animal furs, for example fox, raccoon dog, marten etc. can be obtained.

Furthermore, by giving three-dimensionally varied color in a certain color and superposing another three-dimensionally varied color thereon, an article having an appearance similar to the highest grade of natural fur or a high grade of design effect which is not possessed by natural fur can be obtained.

By combining two or more piles having different finenesses and lengths of the filaments and two-dimensionally or three-dimensionally distributing the variation of the length and/or fineness of at least one kind of piles, a high grade of article having three-dimensionally varied appearance, touch and color can be obtained.

By combining the three-dimensional variation of the fineness and/or length of the piles with the three-dimensional variation of the color, an article having an appearance similar to the highest grade of natural fur or a high grade of design effect which is not possessed by natural fur can be obtained.

As the piles, use may be made of polyamide, polyester, polyvinyl, acrylic, polyolefin, regenerated fibers and other artificial fibers, natural fibers, such as cotton, wool, silk, which can be dyed, decolored, dissolved or decomposed. The piles are most preferably to ones having a double structure of guard hairs and wools but are not limited thereto, and piles consisting of only one kind of piles and ones having three or more kinds of piles are included in the present invention.

The variation of the color, fineness or length of the piles along a three-dimensional surface means, of course, that variation is caused in the properties, such as dyeability, decoloring ability, solubility or decomposing ability, of the pile groups.

As the filaments for wools and guard hairs, acrylic, polyester, polyamide fibers are particularly preferable.

In particular, polyester fibers are advantageous because the fibers are sensitive to an aqueous alkali solution and are easily decomposed and removed and do not cause contamination owing to the dissolved polymer in the dissolution and removal due to a solvent. It is a useful to use a polyester which has been modified (a third component is copolymerized or mixed) so as to be easily decomposed and removed, as such or mixed with non-modified polyester or other fibers, because the working is easy and such a polyester fiber can be varied into different fibers and filament lengths. If it is necessary to use flame retardant fibers in view of the safety, it is preferable to use flame retardant acrylic, polyamide, polyester and cellulose fibers. In general, fibers containing a halogen, phosphorus, sulfur, nitrogen, antimony or zirconium as a flame retardant component are well known and are preferable for the present invention. For example, as flame retardant acrylic fibers, the fibers obtained by copolymerizing vinyl chloride or vinylidene chloride are well known, as flame retardant polyamides, the polyamides mixed with a melamine compound or a bromine compound are well known, as flame retardant polyester fibers, polyesters copolymerized or mixed with a bromine compound, a phosphorous compound, phosphorus-bromine compound and/or a sulfur compound are well known and as flame retardant cellulose fibers, the fibers mixed with a phosphorus compound and/or a halogen compound are well known.

If necessary it is preferable for the present invention to use fibers having antistatic properties. For example, polyester, polyamide or acrylic fibers copolymerized or mixed with polyalkylene ether, polyalkyleneether ester block polymer or polyalkylene ether ester vinyl compound may be used.

The wools are usually less than 10*d*, particularly less than 5*d* and in many cases about 0.5–3d (of course, wools of less than 0.5d may be produced and are useful). In many cases, the wools are crimped and the pile density is 1,000–100,000 f/cm$^2$ and particularly 10,000–50,000 f/cm$^2$. On the other hand, the guard hairs have no crimps in many cases or have a low crimp degree and the fineness thereof is more than 5*d, particularly more than* 10d, in many cases 15–200d and the pile density is 50–5,000 f/cm$^2$, particularly 100–1,000 f/cm$^2$.

The guard hairs wherein the top portion and the root portion are attenuated are most preferable, but the guard hairs wherein only the top portion is attenuated and the fineness is uniform may be used. The length of the piles is about 0.5–10 cm but a length of about 1–6 cm is the most preferable and the length may be uniform or different.

The crimped piles may be used as mentioned above but non-crimped piles may also be used. The cross-section of the piles may be circular or non-circular. The piles may contain or not contain a delustering agent (titanium oxide particles etc.) The piles may be subjected to surface treatment in order to provide luster, waterproofing property, stainproofing property, hydrophilic property, antistatic property, flame retardance, melt preventing property and the like.

FIGS. 1–15 show the embodiments wherein the piles stand upright with respect to the substrate fabric but the present invention includes inclined piles, fallen down piles and/or curved piles. In such a case, the piles may be raised by a proper means (for example heat-treatment under centrifugal force) to determine the color varying surface, fineness varying surface or filament length varying surface.

The pile articles of the present invention can be relatively easily produced. The production method will be explained hereinafter.

The pile articles of the present invention can be produced by raising the piles by the action of a proper external force, for example a centrifugal force, electrostatic force (coulomb force), magnetic force, floating force and the like and varying the distance of an interface of a treating liquid from the substrate fabric according to place to contact the piles with the treating liquid. As the external force, the centrifugal force is highest in the practicability, so that an explanation will be made with respect to the process using centrifugal force hereinafter.

FIG. 16 is an explanatory view (cross-sectional view) showing a basic form of a process wherein the piles are straightly raised by a centrifugal force and the raised piles are treated. In FIG. 16, a substrate fabric 1 having the piles 3 is fixed to a rotating supporter 4 and the piles 3 are raised outwardly owing to the centrifugal force due to rotation. A treating liquid 7 for the fibers is held in an outer rotary cylinder 5 and a cylindrical interface 8 is formed owing to the centrifugal force and the piles 3 are contacted with the treating liquid and treated therewith (for purposes of dyeing, decoloring, dissolving, decomposing and the like). 6 is a rotary axis, 10 is a feeding line for the treating liquid, 11 is a control valve, 12 is a discharging line for the treating liquid and 13 is a control valve. By controlling an amount of the treating liquid 7, it is possible to control the position of the liquid surface 8 and treat a desired position of the piles for a desired time at a desired temperature to effect a desired treatment. The process wherein the piles are raised owing to the centrifugal force and contacted with the treating liquid forming an interface owing to the centrifugal force to treat the pile article is referred to as "centrifugal working process" hereinafter. In the process shown in FIG. 16, the substrate fabric is held around a cylinder concentric to the rotary axis, so that the piles are uniformly treated and the treating condition does not vary according to place. Such a process is utilized for an object for uniformly working the piles, for example for uniformly attenuating (sharpening) or cutting the top of the piles or gradationally dyeing the piles uniformly toward the upper and lower directions.

FIG. 17 shows an embodiment of a method for producing the pile articles of the present invention and is a partial view of a method in which the method shown in FIG. 16 is more or less complicated. In FIG. 17, the substrate fabric 1 having the piles 3 is fixed to a rotary inner cylinder 4 but a spacer 14 is used so that the distance of the treating liquid surface 8*a* or 8*b* from the substrate fabric varies according to place. As the treating liquid, use is made of two kinds of liquids of an inside treating liquid 7*a* and an outside treating liquid 7*b* but of course, it is possible to use only one kind of treating liquid as shown in FIG. 16. When a dyeing solution is used as the inside treating liquid 7*a* and an inert liquid is used as the outside treating liquid 7*b*, only the desired position (for example the middle portion) of the piles can be dyed. In this case, it is necessary that the outside treating liquid 7*b* is not mixed with the inside treating liquid 7*a* and has a higher density than the inside treating liquid 7*a* and a lower density than the piles.

In FIG. 17, a corrugated spacer 14 is used in order to vary the distance of the treating liquid from the substrate fabric according to place but the use of various spacer shapes can provide pile articles having the desired color-varied surfaces. By making the substrate fabric in a cylindrical form eccentric to the treating liquid surface 8*a* or 8*b* or in a cone (frusto-conical) having the same axis as the rotary axis, it is possible to obtain a product wherein the color varying surface is an inclined surface. Other than by such a process, desired color varying surfaces can be formed by keeping the substrate fabric so that the distance of the treating liquid surface from the substrate fabric is increased or decreased in a given gradient, varied in a given curvature or in a wave form. 15 is a screw for fixing the substrate fabric to the rotary cylinder but said screw can be replaced with a rivet, a wire, a surface fastener and the like. If fixing points are properly arranged, the substrate fabric is pulled outwardly and floated due to the centrifugal force even without using a spacer and the unevenness is formed on the substrate fabric surface.

In order that the piles 3 are raised even in the treating liquid 7, the density of the piles should be higher than that of the treating liquid. The specific gravity of the major part of fibers is more than 1 and is higher than that of aqueous treating liquids, so that there is no problem.

When the treating liquid is a dyeing solution, the treatment as shown in FIG. 16 dyes the top portion of the piles 3. If the position of the interface 8 is controlled by the control of the amount of the dyeing solution, the desired position of the piles can be dyed. For example, if the position of the interface is gradually moved from a certain position to another position, as the position moves toward the top of the piles 3, the top portion is dyed in more deep color (gradationally dyed). Similarly, by treating the previously dyed piles with a decoloring liquid, the top portion of the piles is decolored or the top portion is more highly decolored as the position moves toward the top. Furthermore, by decoloring the middle portion and the top portion of the previously dyed piles and then dyeing the top portion, the piles colored into triple colors can be obtained. Other than the above described means, by freely combining the dyeing, the decoloring and the control of the treating liquid surface by using at least one treating liquid, the colored state of one pile can be complicatedly and delicately varied along the longitudinal direction. Furthermore, by varying the surface of the substrate fabric three-dimensionally, a three-dimensionally varied color can be obtained.

The control of the interface (the treating liquid surface) can be easily carried out by controlling the treating liquid by means of a pump or valve. The treating liquid surface can be monitored or automatically controlled by using a proper liquid level detecting device. The treating temperature can be optionally controlled and if necessary, the treatment can be effected under atmospheric pressure, under pressure or a reduced pressure.

The processes shown in FIG. 16 and FIG. 17 can be utilized not only for dyeing and decoloring but also for attenuating the top portion, root portion of the piles and any other portions or cutting the piles.

The variation of the fineness of the piles or the cutting can be carried out by using a solvent or a solution of a decomposing agent as the treating liquid. As the solvent, ones which dissolve the fibers in turn from the surface, without swelling the fibers too much, are preferable. As the decomposing agent, an aqueous solution of a strong alkali, such as sodium hydroxide for polyester fibers, is well known and in this case, the fibers are gradually decomposed and removed from the surface as the fibers are ground, so that this means is particularly preferable. For example, in FIG. 16, by gradually moving outwardly the interface of the treating liquid by using polyester fiber (polyethylene terephthalate, polyethylene oxybenzoate etc.) for the piles 3 and an aqueous solution of sodium hydroxide (1–30%) heated at 60°–100° C. as the treating liquid, the piles can be gradually attenuated from the middle portion toward the top portion. Similarly, if the interface is kept for a sufficient time, the piles are cut. When an aqueous alkali solution is used as the first treating liquid, an inert liquid having a slightly higher density is used as the second treating liquid and the first treating liquid is brought in contact with the desired position of the piles, for example the root portion or the middle portion, said portion can be attenuated. Furthermore, in the process as shown in FIG. 16, by holding the substrate fabric in a wave form, the piles can be cut or sharpened in a wave form. In the same manner, the piles can be partially swelled or the latent crimps can be developed in the process in FIG. 16 or FIG. 17. Both the crimped piles and the non-crimped piles can be similarly applied. The piles can be heat-treated by using a liquid or various gases.

The centrifugal force applied in the present invention must have an enough power to raise the piles and form a cylindrical liquid surface (interface) in the treating liquid and is generally more than 3 times (3 G) of the gravity acceleration G, in many cases more than 5 times (5 G), preferably more than 10 times (10 G) and particularly more than 30 times (30 G). As the acceleration due to the centrifugal force becomes larger (particularly more than 100 G), the raising ability of the piles is higher but the centrifugal force is limited to less than 10,000 G in practice in view of the mechanical strength. For example, when the radius is 1 m and the rotating speed is 1 rotation per 1 second, the centrifugal force is about 4 G but the raising ability of the piles and the cylinder-forming ability of the liquid surface of the treating liquid are somewhat low. When the rotating speed is 10 rotations per 1 second, the centrifugal acceleration is about 400 G and is satisfactory. In the crimped piles, when the acceleration is too large, there is fear that the crimps are elongated, so that it is necessary to select the proper acceleration.

The direction of the rotary shaft 6 may be horizontal, perpendicular or any other angle. In order to control the liquid surface, an inlet, an outlet, a pump, valves, and a liquid level detector for a treating liquid may be provided. Of course, a heating or cooling device, or temperture detecting device for controlling the temperature of the treating liquid, may be provided.

The rotary angle velocity of the holding portion of the piles and the treating liquid may be equal or more or less different. The equal case is advantageous, because the rotary axis and the driving system can be used together. When the rotary angle velocity is different, the treating liquid is stirred and the more uniform treatment is feasible. When the velocity difference is too high (for example, more than 1 rotation/sec.), the raising of the piles is disturbed and such a case is not preferable. Furthermore, in order to keep the uniformity of the treating liquid, it is possible to provide a pump in the system of the treating liquid and circulate the liquid.

As the fibers for composing the piles, use may be made of natural fibers, chemical fibers, synthetic fibers and other fibers. The fibers for composing the piles may be a mixture of two or more kinds of fibers. For example, by applying the method of the present invention to pile articles consisting of two or more fibers having different fineness, cross-sectional shape, dyeability, decoloring ability, decomposing ability, solubility, shrinkability, crimpability, latent crimpability, self separating ability and the like, for example, jacquard knitted or woven fabrics, products having complicated color, appearance and feeling can be produced.

In the present invention, complicated and high grade design effects can be obtained by holding the substrate fabric in a wave form. FIG. 18 and FIG. 19 show the embodiments of wave formed substrate fabrics. FIG. 18 is an embodiment having a single directional wave form wherein the substrate fabric 1 does not vary in the direction X but varies in a wave form in the direction Y (circumferential direction of the cylinder 4) and FIG. 19 is an embodiment having a single directional wave form wherein the substrate fabric 1 varies in a wave form in the direction X but does not vary in the direction Y. It is relatively easy to hold the forms of the substrate fabrics as in FIG. 18 and FIG. 19.

FIG. 20 is an embodiment having irregular wave forms (unevenness) in two directions X and Y. In the processes of FIG. 18–FIG. 20 and the similar processes, by selecting a proper wave form depending upon the design object, the products having the desired three-dimensional color variation can be obtained.

FIG. 21–FIG. 26 are plan views showing embodiments of appearance of the pile articles having varied colors obtained by the processes of FIG. 18–FIG. 20 and the like. In these drawings, the part 16 and the part 17 show different colors. Of course, the parts 16 and 17 vary gradually in color and the boundary thereof shows the intermediate of both the colors. For example, in FIG. 7 there is an intermediate color pile group 18 colored into two colors of deep color and light color between a light colored (white) pile group 16 and a deep colored (black) pile group 17. It is the characteristics of the products and the production method of the present invention that the color varies three-dimensionally and continuously. In FIG. 21–FIG. 26, the zones of the intermediate color pile groups are omitted.

In the products of FIG. 1–FIG. 6, the color variation is very high in the continuity and it is very difficult to classify the color zone distinctly but in macroscopic view, a portion highly rich in a certain color and a portion highly rich in another color are two-dimensionally distributed (for example, as shown in FIG. 21–FIG. 26).

Such a continuous color variation gives a unique and high grade of design effect, which is similar to natural furs or has never been found in natural furs, while the colors of the pile articles of Jacquard knitted or woven fabrics obtained by using different color yarns or printed articles vary intermittently, are not delicate and are poor in the feeling. However, by using the Jacquard process and the printing process together with the method of the present invention, excellent products can be obtained and such products are included in the products of the present invention.

Thus, explanation was made with respect to the three-dimensional variation of the color of the piles and the two-dimensional variation of appearance of the products resulting therefrom but when the fineness or length of the piles are three-dimensionally varied, the same results are obtained. For example, when the substrate fabric is held in wave forms in the processes as shown in FIG. 18–FIG. 20 and the piles are attenuated or cut by means of a solvent or a decomposing agent as the treating liquid, the products wherein the length or the attenuating degree of the piles are two-dimensionally distributed as shown in FIG. 21–FIG. 26, can be obtained. In this case, the portions 16 and 17 in FIG. 21–FIG. 26 show that the length and/or the attenuated state of the piles are different. Of course, the intermediate portions of both the portions are shifting zones but are omitted in the drawings.

Such three-dimensional variations of the length or fineness of the piles give a unique and high grade of design effect which is similar to natural furs or has never been found in natural furs. The appearance of the pile articles of Jacquard knitted or woven fabrics obtained by using yarns having different lengths and finenesses is intermittent in variation, is not delicate and is poor in the high grade of feeling. However, excellent products can be obtained by using Jacquard process and the printing process together with the method of the present invention and such products are involved in the present invention.

The substrate fabrics to be used in the production of the products of the present invention are selected from woven fabrics, knitted fabrics, non-woven fabrics and other cloths, leather-like or sheet-like materials. However, in order to form a two directional wave surface as shown in FIG. 14 upon centrifugal working, a substrate fabric having a high stretchability is preferable. For example, the fabrics having an elongation percent of more than 10%, particularly more than 20% are desirable for forming wave surfaces having a high unevenness. As a texture having a high stretchability, mention may be made of woven fabrics, loose knitted or woven fabrics containing elastic yarns (rubber, spandex and the like). It is preferable in many cases that after the substrate fabric is subjected to a centrifugal treatment in an uneven form, in the final product, the substrate fabric returns to a plane or a form near a plane, so that it is preferable that the substrate fabrics have a high elastic recovery of elongation, for example a recovery of more than 50%, particularly more than 75%. The recovery of irregularly deformed substrate fabrics owing to the centrifugal working into the plane can be promoted through a stretching or relaxing heat treatment, a boiling water treatment, rubbing and loosing and the like. After the centrifugal working, it is possible to impregnate the substrate fabric with an elastic resin (rubber, polyurethane resin and the like), raise the back surface or subject the piles to a surface treatment (applying an oil composition, resins).

In the method of the present invention, the interface of the treating liquid can be controlled with high precision, if necessary, and different treatments can be carried out precisely to each portion of the piles. However, in prior arts, for example in the process shown in FIG. 1 in Japanese Patent Application Publication No. 4,910/73 wherein a treating liquid is filled in a vessel, piles are suspended downwardly and the top of the piles is immersed in the treating liquid, the treating liquid is sucked up between the piles due to a capillary phenomenon and the place which should not be treated is irregularly treated or contaminated, and such a process has a great demerit. In the method of the present invention, the penetration of the treating liquid into the portion due to such a capillary phenomenon can be prevented by using a sufficient centrifugal force, for example more than 10 G, particularly more than 30 G. In general, the piles are often fallen down, crimped or loosely curled in the former production step and it is difficult to uniformly raise the piles, but in the present invention, the piles may be raised by force several times as high as gravity, if necessary several tens times or several hundred times by the centrifugal force, so that the precision and uniformity of the treatment are considerably improved.

The pile articles of the present invention have very high grade of and complicated appearance and can provide the same or more aesthetic property as natural furs. Natural furs cannot be freely controlled as to the color, fineness and length of the piles, but as mentioned above, the products of the present invention can be freely controlled as tothe color if necessary, so that more excellent designs than natural furs can be obtained.

BEST MODE OF CARRYING OUT THE INVENTION

EXAMPLE 1

A polymer obtained by copolymerizing 92% by weight (hereinafter, % means by weight) of acrylonitrile, 7% of methyl acrylate and 1% of sodium allylsulfonate was referred to as polymer P-1, and a polymer obtained by copolymerizing 89% of acrylonitrile, 10% of methyl acrylate and 1% of sodium allylsulfonate was referred to as polymer P-2. The polymers P-1 and P-2 were dissolved in dimethylformamide (DMF) respectively, and subjected to a wet conjugate spinning by using a water/DMF mixture as a coagulation bath in a side-by-side relation and in a conjugate ratio of 1/1. The spun filaments were drawn to 8 times their original length in water kept at 100° C., and then shrunk by 15% in water kept at 100° C. The shrunk filaments were dried in air kept at 120° C. to obtain acrylic composite filaments F-1 (120 d/100 f) having a latent crimpability.

A cut pile knitted fabric CP-1 was formed by using the filaments F-1 as a pile yarn and nylon-6 filaments F-2 (150 d/40 f) as a ground yarn. The cut pile length was 22 mm, pile density was about 10,000 filaments/cm$^2$, the stretching percent was about 50% in the longitudinal direction and about 100% in the lateral direction.

A polyester obtained by copolymerizing 95% of ethylene terephthalate and 5% of polyethylene glycol having a molecular weight of 600 was referred to as polymer P-3. The polymer P-3 (containing 0.6% of titanium oxide) was melt spun, and the spun filaments were drawn to 3.5 times their original length at 100° C. and then heat treated at 145° C. to obtain filaments F-3 of 180 d/4 f.

Figure 16:
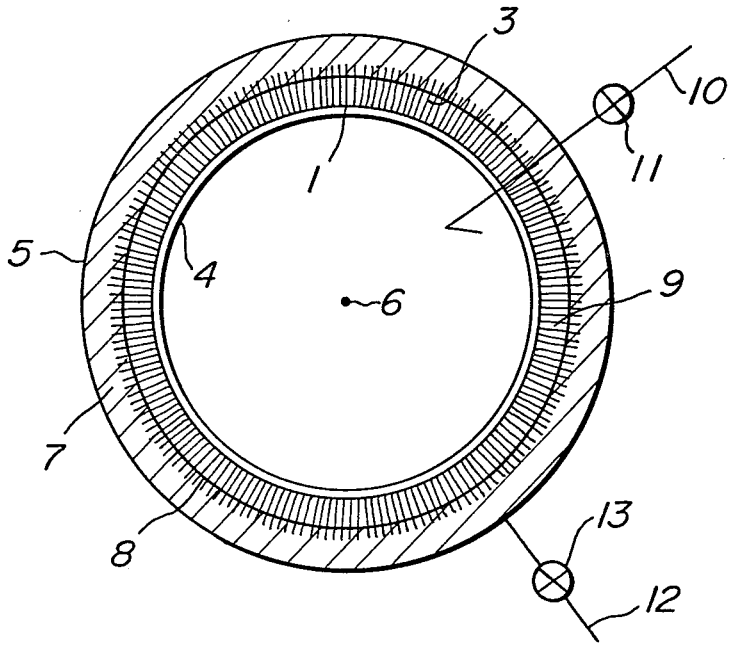
FIG. 16 and FIG. 17 are explanatory views of methods for producing the pile articles of the present invention.

The cut pile knitted fabric CP-1 was flocked with the filaments F-3 in a pile density of about 400 filaments/cm$^2$ by a tufting method to obtain a cut pile knitted fabric CP-2 having a cut pile length of 45 mm. The pile knitted fabric CP-2 was a double-structured pile article wherein the piles consisting of the filaments F-1 correspond to wools and the piles consisting of the filaments F-3 correspond to guard hairs. However, the guard hairs were coarse and rigid and were poor in the appearance and feeling. In order to eliminate these drawbacks, the root portion and top portion of the guard hairs of the pile knitted fabric CP-2 were attenuated by the method illustrated in FIG. 16. This process will be explained hereinafter in detail.

The pile knitted fabric CP-2 was fixed to an inner cylinder 4 having a diameter of 1 m, and was rotated at a rate of 600 revolutions/min together with an outer cylinder having a diameter of 1.2 m to raise piles by the centrifugal force. Then, a mixture of carbon tetrachloride and liquid paraffin having a specific gravity of 1.2 was charged into the outer cylinder up to a position, where a distance of the surface of the mixture from the substrate fabric 1 was 15 mm, and then an aqueous solution containing 5% of sodium hydroxide and 0.5% of an alkali hydrolysis promotor (DYK-1125, made by Ipposha Oil and Fat Co.) was charged in the outer cylinder up to a position where a distance of the surface of the aqueous solution from the substrate fabric was 2 mm. The pile knitted fabric CP-2 was treated with the aqueous alkali solution at 70° C. for 90 minutes at the above described position to dissolve partly the root portion of the guard hairs and to decrease the fineness thereof to substantially ½ (by weight). Then, the mixture of carbon tetrachloride/liquid paraffin was removed, and the same aqueous alkali solution as described above was charged into the outer cylinder so that the distance of the surface of the aqueous alkali solution from the substrate fabric became 45 mm, and further the aqueous alkali solution was gradually added to raise the liquid surface up to a position 35 mm distant from the substrate fabric in 90 minutes. Then, the aqueous alkali solution was gradually removed to lower the surface to a position 45 mm distant from the substrate fabric in 90 minutes. Then, the aqueous alkali solution was wholly removed, and the above treated pile woven fabric was thoroughly washed with water to obtain a pile knitted fabric CP-3 having guard hairs (consisting of filaments F-3) having attenuated root portions and top portions.

Then, the pile knitted fabric CP-3 was subjected to the dyeing process. The CP-3 was firstly treated with an aqueous solution of a grey basic dyestuff (Bayer Japan Co., Astrazun Grey BL) at 100° C. for 30 minutes to dye the acrylic piles (wools) with a grey color (0.1% owf).

Figure 1:
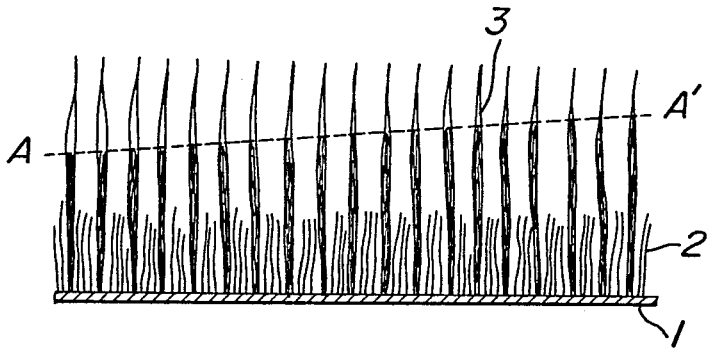
FIG. 1 to FIG. 15 are explanatory schematic views showing embodiments of the pile articles of the present invention.
Figure 2:
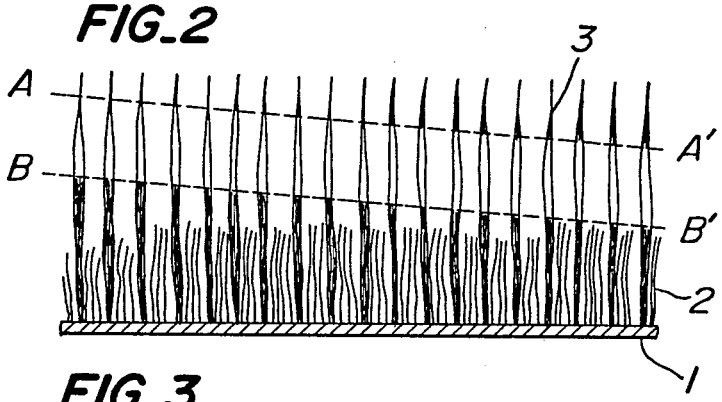
Figure 3:
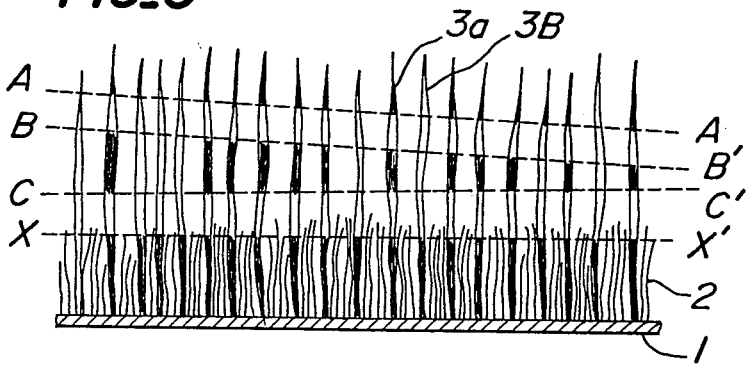
Figure 4:
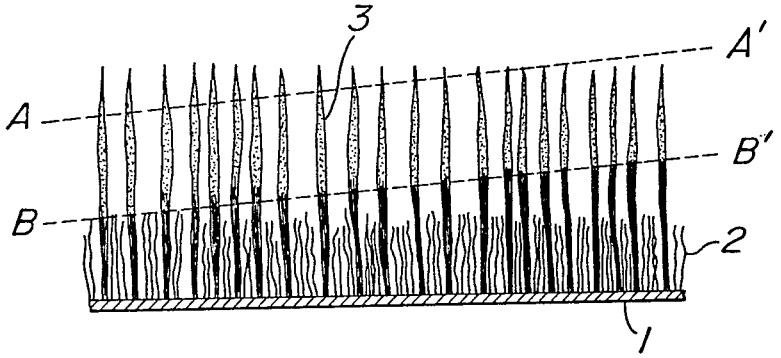
Figure 5:
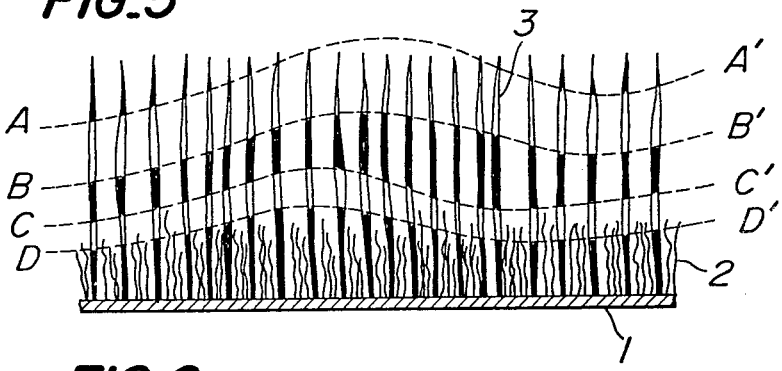
Figure 6:
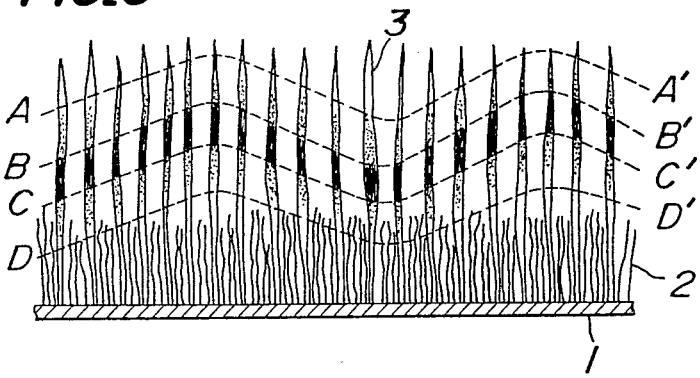
Figure 7:
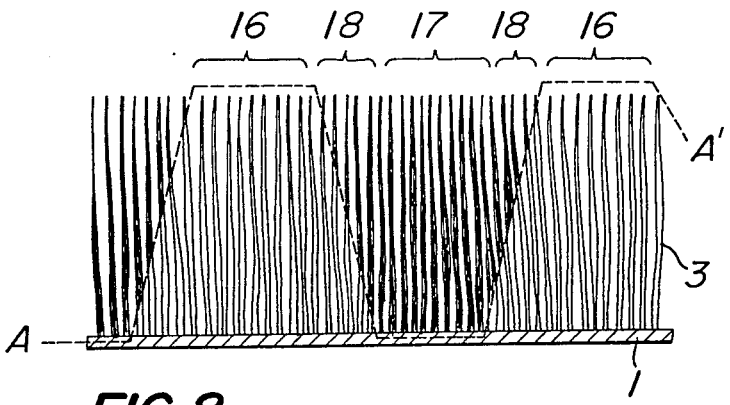
Figure 8:
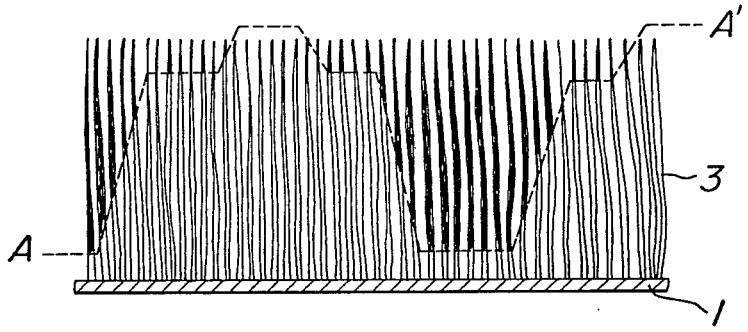
Figure 17:
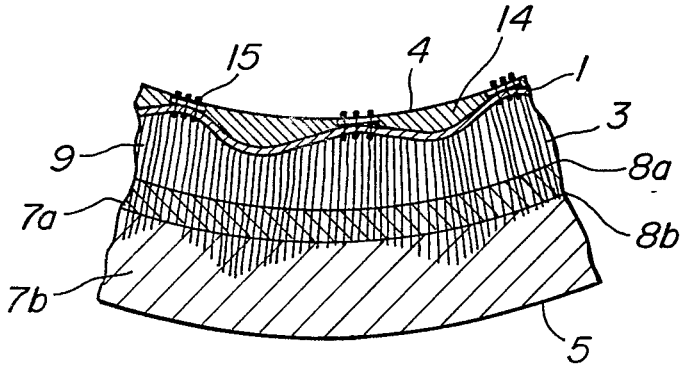
Figure 18:
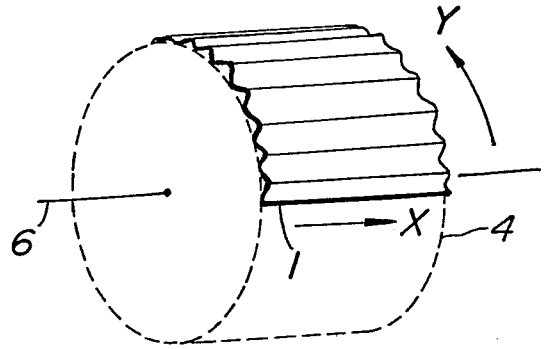
FIG. 18–FIG. 20 are explanatory views showing embodiments of methods for fixing the substrate fabric upon producing the pile articles of the present invention.
Figure 19:
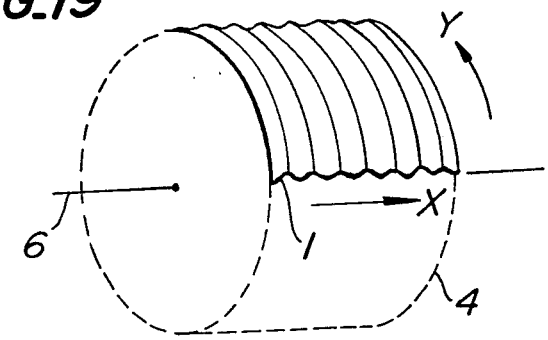
Figure 21:
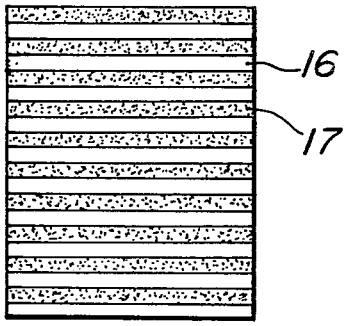
FIG. 21 to FIG. 26 are plan views showing embodiments of the plan distribution of the color, length or attenuated states of the piles in the pile articles of the present invention.
Figure 24:
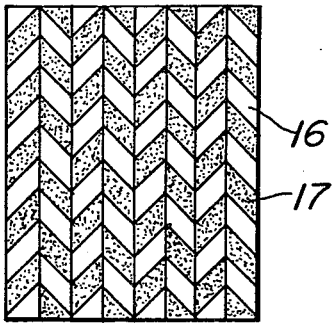
Figure 22:
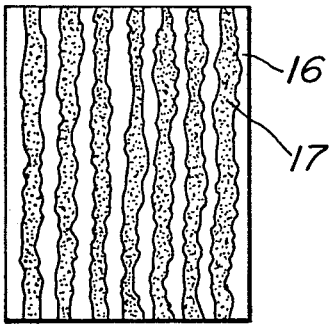

Then, the polyester piles (guard hairs) were dyed in the method shown by FIG. 17. As a spacer 14 use was made of a one-dimensional corrugate plate. The substrate fabric was fixed as shown in FIG. 18. As a dyeing solution *7a*, use was made of an aqueous solution (depth of said solution: 12 mm) of black disperse dye (Kayalon Polyester Black T made by Nippon Kayaku Co.) and as an outside liquid *7b* use was made of a mixture (density: 1.2) of tetrachloroethylene/liquid paraffin. Firstly, an outer interface 8*b* was adjusted at the position where the distance from a valley portion (concave portion) of the substrate fabric was 40 mm and then the outside liquid 7*b* was gradually added to raise the interface 8*b* and the interface 8*b* was raised to the position where the distance from the valley portion of the substrate fabric was 20 mm in 20 minutes and then the dyeing was effected for 30 minutes, after which the dyeing solution and the mixed liquid were wholly removed and the dyed fabric was washed with water and then dehydrated. The cross-section of the obtained pile article CP-4 was a gradational dyeing as shown in FIG. 6 and said article showed the two-dimensional color distribution as shown in FIG. 21 and a very beautiful and high grade of appearance. When the substrate fabric is held in a wave form and processed, the piles are heat set in such a state and if the substrate fabric is returned to a plane, the piles may be undulated in a wave form. When the undulation is remarkable, the appearance may be deteriorated but when the undulation is moderate and gentle, such an undulation gives a variation to the surface of the piles, so that such an undulation is rather preferable. For such a heat setting, the process shown in FIG. 17 can be applied. In order to heat set all the piles in straightly raised state, the process shown in FIG. 16 may be applied. As a heat medium for such a heat treatment, water and other liquids and gases, such as steam and air are used.

In the pile article CP-4, a back surface of the substrate fabric was impregnated with polyurethane (amount of polyurethane applied: 17%) and the piles were subjected to silicone stainproofing water repellent processing (using Scotch Guard FC-453, made by Sumitomo 3M Co., applied amount 1% owf) to obtain the final product CP-5.

EXAMPLE 2

Figure 9:
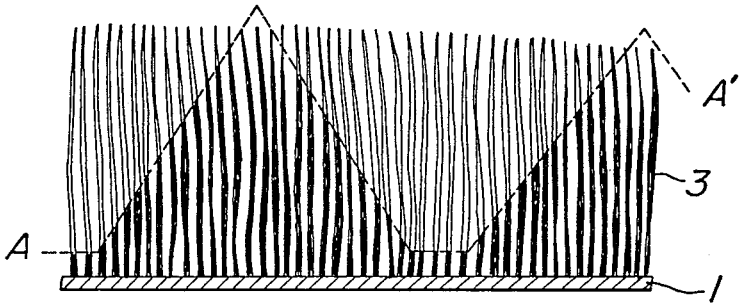
Figure 10:
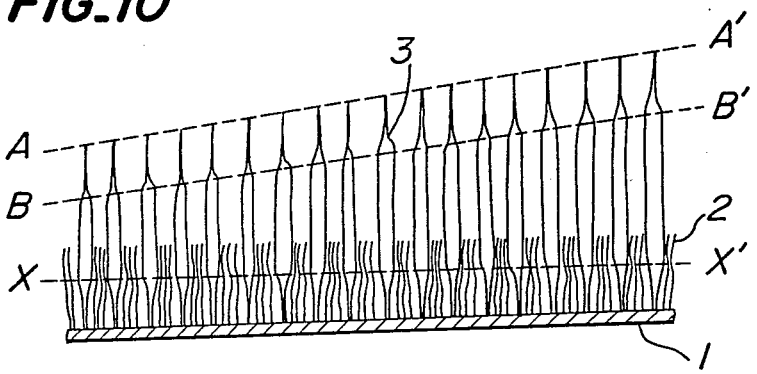
Figure 20:
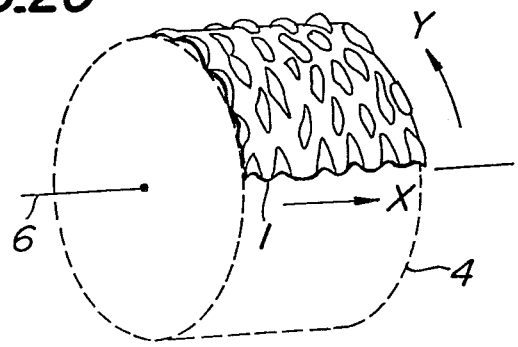
Figure 25:
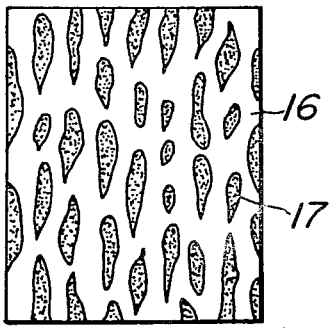
Figure 23:
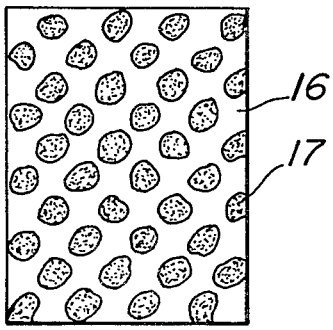
Figure 26:
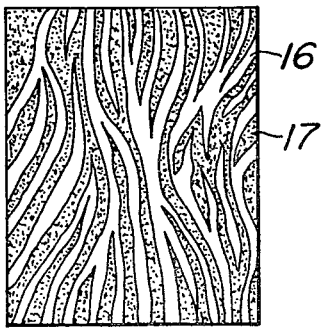

The pile knitted fabric CP-3 in Example 1 was dyed in the process shown in FIG. 17. As a spacer 14, use was made of a two-dimensional irregular corrugate plate and the substrate fabric was fixed as shown in FIG. 20. As a dyeing solution 7*a*, use was made of the disperse dye solution in Example 1 and the depth of the solution was made to be 40 mm. As an outside liquid 7*b* use was made of the same liquid as used in Example 1 and the outer interface 8*b* was set at the position where the distance from the valley (concave) portion of the substrate fabric was 40 mm. The dyeing was effected at 98° C. for 60 minutes and then the liquids were discharged and the pile knitted fabric was washed with water and then dried. Thereafter in the same manner as described in Example 1, the substrate fabric was impregnated with a polyurethane resin and the piles were subjected to a stainproofing water repellent treatment to obtain the final product CP-6. The color distribution in the cross-section of CP-6 is shown in FIG. 9 and the two-dimensional color distribution is shown in FIG. 25. CP-6 has a very high fashion ability and is beautiful.

In Examples 1 and 2, as the colors, white, grey and black were used but as ones other than the above described colors, colors which are the major part of colors of animal furs, for example brown, light brown, yellow and the like may be used and similarly, the decoloration may be effected. Furthermore, fashionable colors, such as red, blue, green, yellow, orange, yellow green, purple, dark blue, pink and the like can be selected. Furthermore, it is possible that a dyeing is effected with a certain color, for example in a wave form and then the color dyed in a wave form is doubled, gradiationally colored or complexed with another color to obtain a further complicated appearance. As the combination of such colors, any combination can be selected from numerous combinations of white/grey/brown/black, white/grey/blue purple/black, black/purple/blue/brown, red/white/blue/purple, yellow/black/white/orange, yellow/green/white/blue depending upon the design object. It has been impossible to color the piles precisely with such a large number of colors in optional and desired forms in the prior art.

In Examples 1 and 2, acrylic fibers were used as the wools but as the wools, polyamide, polyester fibers and the like are preferable. Similarly, as the guard hairs, polyamide, acrylic fibers and the like are preferable other than polyester fibers. Polyester fibers are advantageous because the top portion and the other portions are easily attenuated with an alkali treatment. In particular, the modified (copolymerized or mixed) polyester as shown in the example is sensitive to an alkali and can be dyed at a temperature of lower than 100° C. (under atmospheric pressure), so that the polyesters are easily worked and are preferable.

EXAMPLE 3

A pile knitted fabric CP-1 obtained in Example 1 was flocked with Filament F-3 by a tufting method in a monofilament density of about 400 f/cm$^2$ to obtain a pile knitted fabric CP-7 having a cut pile length of 50 mm. The fabric CP-7 is a pile article having a double structure wherein the piles composed of Filament F-1 correspond to the wools and the piles composed of Filament F-3 correspond to the guard hairs but the guard hairs are coarse and rigid and the appearance and the touch are poor. Accordingly, the root portion of the guard hairs of the pile article CP-7 was subjected to an attenuating treatment by the process shown in FIG. 16. That is, the pile article CP-7 was fixed to a conical inner cylinder 4 having a length of 1 m, a minimum diameter of 1 m and a maximum diameter of 1.03 m and rotated at a rate of 600 revolution/minute together with an outer cylinder having a diameter of 1.2 m, and the piles were raised by the centrifugal force. A mixture of carbon tetrachloride and liquid paraffin having a specific gravity of 1.2 was charged in the above described outer cylinder to a position where the distance from the substrate fabric 1 was 30 mm at the minimum diameter portion of the inner cylinder and then the aqueous alkali solution used in Example 1 was charged in the outer cylinder up to a position where a distance of the surface of the aqueous solution from the substrate fabric was 15 mm.

Figure 11:
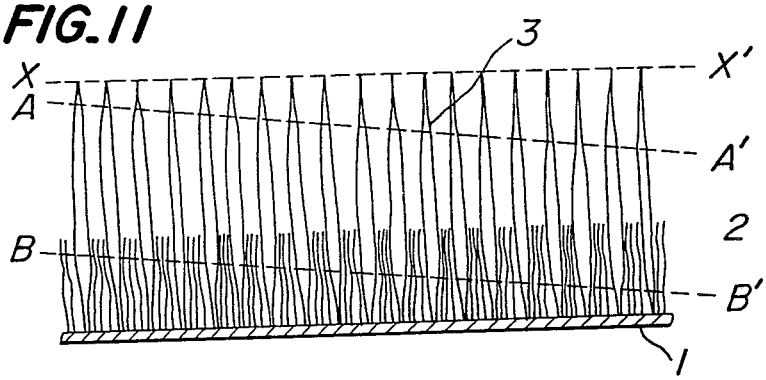

The fabric CP-7 was treated with the aqueous alkali solution at 70° C. for 90 minutes at the above described position to dissolve partially the root portion of the guard hairs and reduce the fineness of the piles to substantially ½ (weight) of the original fineness. Then the carbon tetrachloride mixture was discharged from the outer cylinder and the aqueous alkali solution was charged so that the distance of the aqueous solution from the substrate fabric became 50 mm at the maximum diameter portion of the inner cylinder, and then further aqueous alkali solution was gradually added and the surface of the aqueous alkali solution was raised by 20 mm in 90 minutes. Then the aqueous alkali solution was gradually discharged and was decreased to the original position in 90 minutes. Thereafter, the aqueous alkali solution was completely discharged out and the pile fabric was thoroughly washed with water to obtain a pile knitted fabric CP-8 wherein the root portion and the top portion of the guard hairs (composed of Filament F-3) were attenuated as shown in FIG. 11. The minimum diameter of the top portion of the guard hairs of the pile fabric CP-8 was reduced to about 1/20 of the original diameter.

Then, the pile knitted fabric CP-8 was dyed with an aqueous solution of a grey basic dyestuff (Bayer Japan Co., Astrazum Grey BL) at 100° C. for 30 minutes to dye the piles (wools) of acrylic filament to a light grey color (amount of dyestuff adsorbed, 0.1% owf).

Polyester piles (guard hairs) were dyed by the process shown in FIG. 17. As a spacer 14, use was made of one dimensional corrugated plate and a substrate fabric was fixed thereto as shown in FIG. 18. As a dyeing solution 7*a* use was made of an aqueous solution (depth of said solution: 12 mm) of black disperse dye (Kayalon Polyester Black T, made by Nippon Kayaku Co.) and as an outer liquid 7*b*, use was made of a mixture (density: 1.2) of tetrachloroethylene/liquid paraffin. Firstly, the outer interface 8*b* was adjusted at a position where the distance from a valley portion (concave portion) of the substrate fabric was 40 mm and then the outer liquid 7*b* was gradually added to raise the interface 8*b* and the interface reached by 20 minutes to a position where the distance from the valley portion of the substrate fabric was 20 mm. At this position, the dyeing was effected for further 30 minutes and then the liquid was completely discharged and the dyed fabric was washed with water and dehydrated. The obtained pile article CP-9 was gradationally dyed in the longitudinal direction of piles and showed very beautiful and high grade of appearance.

The back-side of the dyed fabric of the pile article CP-9 was impregnated with a polyurethane elastomer (amount of polyurethane applied: 17%) and the piles were subjected to silicone stainproofing water repellant processing (Scotch Guard FC-453 made by Sumitomo 3M Co., adhered amount: 1% owf) to obtain the final finished product CP-10. The product CP-10 showed very high grade of touch and beautiful appearance.

EXAMPLE 4

A pile knitted fabric CP-7 in Example 3 was subjected to the process for attenuating the root portion shown in FIG. 17. A one-dimensional corrugate plate having a wave length of 15 mm was used as a spacer 14, the substrate fabric was fixed thereto as shown in FIG. 18 and the knitted fabric was rotated at a rate of 600 revolutions/min together with the outer cylinder to raise the piles by the centrifugal force.

Figure 12:
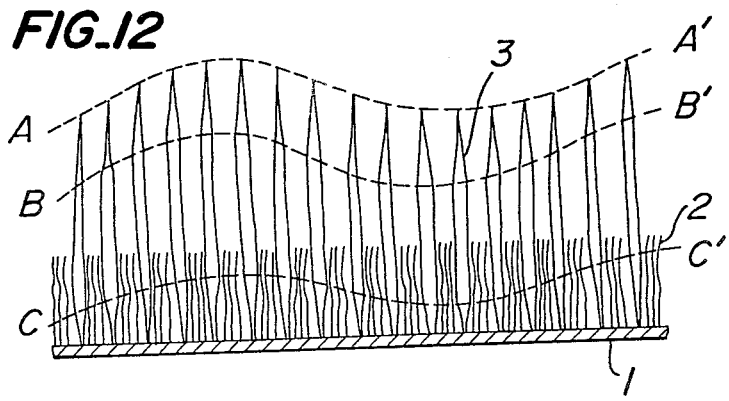
Figure 13:
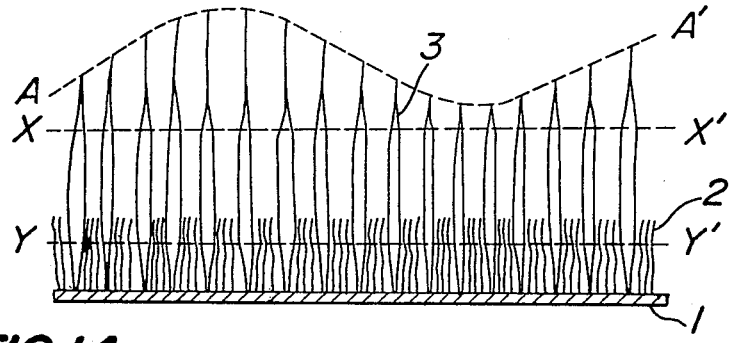
Figure 14:
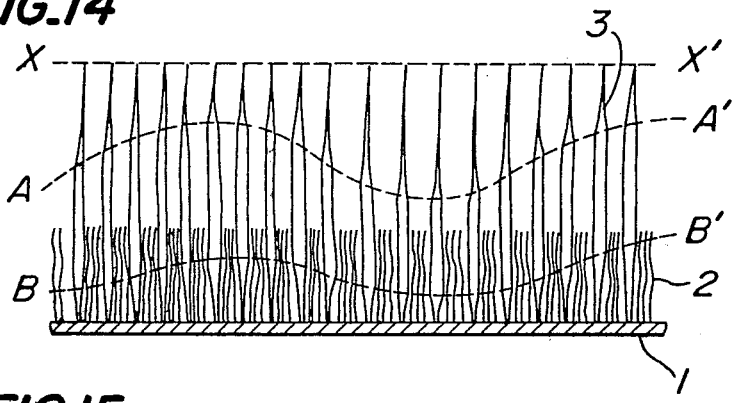
Figure 15:
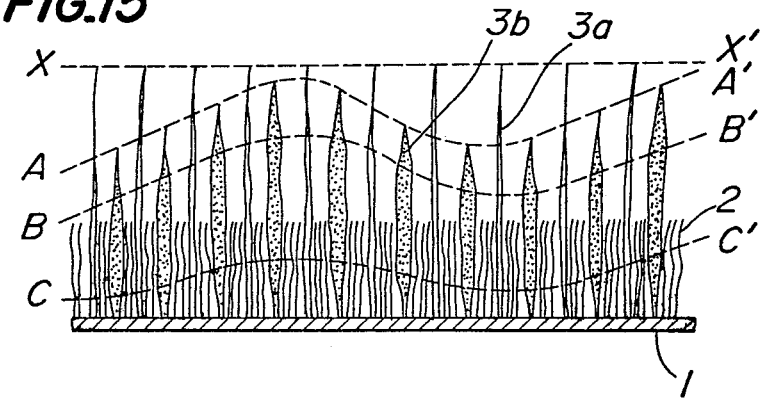

A mixture of carbon tetrachloride and liquid paraffin having a specific gravity of 1.2 was charged to a top portion of a mountaintop of the substrate fabric 1 fixed in a wave form, and then an aqueous solution of 5% of sodium hydroxide and 0.5% of an alkali hydrolysis promoter was charged so that the valley of the substrate fabric was immersed therein. At the above described position, the fabric was treated with the aqueous alkali solution at 70° C. for 90 minutes to dissolve the root portion of the guard hairs and the fineness of the filaments was reduced to ½ of the original fineness. Then the mixture of carbon tetrachloride and liquid paraffin was discharged and the aqueous alkali solution was charged so that said solution surface was positioned 50 mm from the valley of the substrate fabric 1 (35 mm from the mountaintop) and additionally gradually added thereto to raise the solution surface and reach the solution surface to a position where the distance from the valley of the substrate fabric was 40 mm (25 mm from the mountaintop) in 110 minutes. Then the alkali solution was gradually removed to lower the solution surface to the original position in 110 minutes. Then, the alkali solution was completely removed and the thus treated fabric was washed with water to obtain a pile knitted fabric (CP-11 wherein the root portion and the top portion of the guard hairs (composed of Filament F-3) were attenuated. CP-11 has a cross-section similar to FIG. 12. The length of the guard hairs varies along a surface AA', the root portion and the top portion vary the fineness along a surface CC' and a surface BB' respectively, and the minimum diameter of the top portion is substantially (1/50)-(1/100) of the original fineness. The plan view of the variation of the filament length and fineness is shown in FIG. 21. The feeling of this pile article was very similar to that of natural furs. This pile knitted fabric CP-11 was dyed in the same manner as in Example 3 and subjected to a finishing process to obtain a pile knitted fabric CP-12, which showed a very beautiful and high grade of appearance and had a similar grade to the most high class of furs.

We claim:

1. A fur-like article comprising: a substrate fabric sheet simulating the skin portion of a natural fur; a layer comprising a multiplicity of short, soft, first filaments of relatively small diameter projecting upwardly from the substrate fabric sheet; a multiplicity of long, hard, second filaments of relatively large diameter projecting upwardly from the substrate fabric sheet, uniformly distributed among said first filaments and projecting above the upper ends of said first filaments; said first filaments having a fineness of from about 0.5 to 3 d and the density of said first filaments on said substrate fabric sheet being in the range of 10,000 to 50,000 filaments per square centimeter; said second filaments having a fineness of from 15 to 200 d and the density of said second filaments on said substrate sheet being from 100 to 1,000 filaments per square centimeter, said first and second filaments being made of a material selected from the group consisting of synthetic fibers, cotton, wool and silk, at least one of the properties of color and fineness of said second filaments being different in the same way as to each of said second filaments at locations lying on opposite sides of an imaginary surface which is spaced from a surface of said substrate fabric sheet a distance which varies across the length and/or width of the fur-like article.

2. A pile article comprising a substrate fabric and a layer comprising a multiplicity of filament piles projecting upwardly from said substrate fabric, at least one of the properties of color and fineness of said filament piles being different in the same way as to each of said piles on opposite sides of a first imaginary surface which is spaced from a surface of said substrate fabric a distance which varies across the length and/or width of said pile article.

3. A pile article comprising a substrate fabric, a layer comprising a multiplicity of short first filaments projecting upwardly from the substrate fabric, and a layer comprising a multiplicity of second filaments projecting upwardly from said substrate fabric, said second filaments being longer than said first filaments and being uniformly distributed among said first filaments and projecting above the upper ends of said first filaments, at least one of the properties of color and fineness of said second filaments being different in the same way as to each of said second filaments on opposite sides of a first imaginary surface which is spaced from said substrate fabric, said first imaginary surface being spaced a variable distance according to a pattern across the length and/or width of said pile article from a second imaginary surface which passes through said substrate and is perpendicular to said upwardly extending first and second filaments.

4. A pile article as claimed in claim 3, wherein said second imaginary surface is planar, and said first imaginary surface defines a plane which is inclined relative to said second imaginary surface.

5. A pile article as claimed in claim 3, wherein said second imaginary surface is planar, and said first imaginary surface is curved relative to said second imaginary surface.

6. A pile article as claimed in claim 5, wherein said curved first imaginary surface undulates in one direction across the pile article.

7. A pile article as claimed in claim 5, wherein said curved imaginary surface undulates in two mutually perpendicular directions across the pile article.

8. A pile article as claimed in claim 3, wherein at least one of the properties of color and fineness of said second filaments is different on opposite sides of a third imaginary surface which is spaced from said first and second imaginary surfaces, said third imaginary surface being spaced a variable distance across the length and/or width of said pile article from said second imaginary surface.

9. A pile article as claimed in claim 3, wherein said first imaginary surface has a continuously varying wave form having a wavelength in the range of 1 to 10 cm and a wave amplitude of at least 0.5 cm.

10. A pile article as claimed in claim 3, wherein the fineness of said second filament is different on opposite sides of said first imaginary surface, such that the top ends of said second filaments above said first imaginary surface have diameters less than 25 percent of the diameters of adjoining lower portions of said second filaments.

11. A pile article as claimed in claim 10, wherein the fineness of said second filaments is different on opposite sides of a third imaginary surface which is spaced from and interposed between said first and second imaginary surfaces, said third imaginary surface being spaced a variable distance across the length and/or width of said pile article from said second imaginary surface, said first and third imaginary surfaces defining middle portions of said second filaments therebetween, and said third imaginary surface defining root portions of said second filaments below said third imaginary surface, said root portions having diameters in the range of 10 to 90 percent of the diameters of said middle portions.

12. A pile article as claimed in claim 3, wherein said second filaments have a length in the range of 0.5 to 10 cm and a fineness in the range of 15 to 200 d, the density of said second filaments on said substrate being from 100 to 1,000 filaments per square centimeter, said first filaments having a fineness of about 0.5 to 3 d and the density of said first filaments on said substrate fabric being in the range of 10,000 to 50,000 filaments per square centimeter.

13. A pile article as claimed in claim 3, wherein each of said first and second filaments is made of at least one material selected from the group consisting of polyamides, polyesters, polyvinyls, acrylics, polyolefins, cotton, wool and silk.

14. A pile article as claimed in claim 3, wherein the color of said second filaments is different on opposite sides of said first imaginary surface.

15. A pile article as claimed in claim 3, wherein the fineness of said second filaments is different on opposite sides of said first imaginary surface.

* * * * *